US008991370B2

(12) United States Patent
Yamamoto

(10) Patent No.: US 8,991,370 B2
(45) Date of Patent: Mar. 31, 2015

(54) INTAKE APPARATUS OF ENGINE

(76) Inventor: Toshihiko Yamamoto, Kamakura (JP)

( * ) Notice: Subject to any disclaimer, the term of this patent is extended or adjusted under 35 U.S.C. 154(b) by 595 days.

(21) Appl. No.: 13/274,579

(22) Filed: Oct. 17, 2011

(65) Prior Publication Data

US 2013/0047960 A1 Feb. 28, 2013

(30) Foreign Application Priority Data

Aug. 30, 2011 (JP) ..... 2011-187396

(51) Int. Cl.

| | |
|---|---|
| ***F02M 29/00*** | (2006.01) |
| ***F02M 29/04*** | (2006.01) |
| ***F02B 31/00*** | (2006.01) |
| ***F02M 35/10*** | (2006.01) |
| *F02B 25/14* | (2006.01) |

(52) U.S. Cl.

CPC ..... *F02M 35/10281* (2013.01); *F02M 29/04* (2013.01); *F02B 25/145* (2013.01)

USPC ..... 123/590; 123/306; 123/593

(58) Field of Classification Search

USPC ..... 123/306, 308, 590, 593, 184.56

See application file for complete search history.

(56) References Cited

U.S. PATENT DOCUMENTS

| | | | | |
|---|---|---|---|---|
| 1,382,285 | A * | 6/1921 | Harris | 123/556 |
| 1,503,371 | A * | 7/1924 | Meyer | 48/189.4 |
| 2,377,088 | A * | 5/1945 | Linn | 48/189.4 |
| 3,982,504 | A * | 9/1976 | Noguchi et al. | 123/260 |
| 4,114,580 | A * | 9/1978 | Coats | 123/593 |
| 4,295,458 | A * | 10/1981 | Pellerin | 48/189.4 |
| 4,359,035 | A * | 11/1982 | Johnson | 123/593 |
| 4,384,563 | A * | 5/1983 | Siefer et al. | 123/593 |
| 4,492,212 | A * | 1/1985 | Dooley | 123/590 |
| 4,667,648 | A * | 5/1987 | Beldin | 123/593 |
| 5,027,754 | A * | 7/1991 | Morone | 123/184.54 |
| 5,758,614 | A * | 6/1998 | Choi | 123/184.53 |
| 5,915,354 | A * | 6/1999 | Ma | 123/308 |
| 5,924,398 | A * | 7/1999 | Choi | 123/184.21 |
| 6,076,499 | A * | 6/2000 | Klumpp | 123/337 |
| 6,257,212 | B1 * | 7/2001 | Hammond | 123/557 |
| 6,612,295 | B2 * | 9/2003 | Lerner | 123/593 |
| 7,131,514 | B2 * | 11/2006 | Choi et al. | 181/270 |
| 7,322,333 | B2 * | 1/2008 | Isaji et al. | 123/184.59 |
| 7,367,329 | B2 * | 5/2008 | Yamamoto | 123/590 |
| 7,458,344 | B2 * | 12/2008 | Holtorf | 123/73 PP |
| 7,762,229 | B2 * | 7/2010 | Abe et al. | 123/306 |
| 8,051,846 | B2 * | 11/2011 | Sugishita | 123/590 |
| 8,141,538 | B2 * | 3/2012 | Yang | 123/308 |
| 8,166,775 | B2 * | 5/2012 | Choi | 62/426 |
| 2001/0050075 | A1 * | 12/2001 | Lerner | 123/593 |
| 2004/0065296 | A1 * | 4/2004 | Arimatsu et al. | 123/308 |
| 2005/0081821 | A1 * | 4/2005 | Katou et al. | 123/308 |
| 2006/0219202 | A1 * | 10/2006 | Abe et al. | 123/184.56 |
| 2006/0231067 | A1 * | 10/2006 | Masuta et al. | 123/308 |
| 2007/0044780 | A1 * | 3/2007 | Yamamoto | 123/593 |

(Continued)

FOREIGN PATENT DOCUMENTS

JP 07-317613 12/1995

*Primary Examiner* — Hieu T Vo
*Assistant Examiner* — Sherman Manley
(74) *Attorney, Agent, or Firm* — Flynn, Thiel, Boutell & Tanis, P.C.

(57) ABSTRACT

An intake apparatus of an engine provided with a fuel supplying device for supplying fuel into an intake passage, includes: a guide body having multiple holes disposed in the intake passage located downstream from the fuel supplying device. The guide body has a stepped portion extending in a direction intersecting with a direction of a flow of intake air.

12 Claims, 15 Drawing Sheets

(56) References Cited

U.S. PATENT DOCUMENTS

2009/0272356 A1* 11/2009 Abe et al. ..... 123/184.56
2013/0047960 A1* 2/2013 Yamamoto ..... 123/445
2013/0125861 A1* 5/2013 Yamamoto ..... 123/445

* cited by examiner

INTAKE APPARATUS OF ENGINE

BACKGROUND OF THE INVENTION

1. Field of the Invention

The present disclosure relates to an intake apparatus of an engine provided with a fuel supplying device for supplying fuel into an intake passage.

2. Description of the Related Art

Heretofore, examples of an engine mounted on a vehicle such as a two-wheeled motor vehicle include a 2-stroke engine and a 4-stroke engine, and such an engine is provided with an intake apparatus. As the intake apparatus, there is one provided with a fuel supplying device for supplying fuel into an intake passage (Japanese Patent Application Laid-Open No. H07-317613).

Such an intake apparatus is supplied with a mixture of air and fuel. To improve the filling efficiency of the air-fuel mixture, there is an intake apparatus in which a straightening plate or the like is arranged in the intake passage. However, just straightening the air-fuel mixture by the straightening plate in this manner does not bring about a sufficient atomization of the air-fuel mixture and reduction in the harmful components in exhaust gas.

The present disclosure has been made with the view to such circumstances, and an object of the present disclosure is to provide an intake apparatus of an engine that improves an atomizing rate of an air-fuel mixture, improves combustion efficiency and fuel consumption, and reduces harmful components in exhaust gas.

SUMMARY OF THE INVENTION

To solve the above problems and to achieve the object, the present disclosure is configured as follows.

A first aspect of the present disclosure is an intake apparatus of an engine provided with a fuel supplying device for supplying fuel into an intake passage, the intake apparatus including: a guide body having multiple holes disposed in the intake passage located downstream from the fuel supplying device, wherein the guide body has a stepped portion extending in a direction intersecting with a direction of a flow of intake air.

A second aspect of the present disclosure is an intake apparatus of an engine provided with a fuel supplying device for supplying fuel into an intake passage, the intake apparatus including: a guide body having multiple holes disposed in the intake passage located downstream from the fuel supplying device, wherein the guide body has a curved cross-section, and separated passages separated by the guide body are formed in the intake passage.

A third aspect of the present disclosure is an intake apparatus of an engine provided with a fuel supplying device for supplying fuel into an intake passage, the intake apparatus including: a guide body having multiple holes disposed in the intake passage located downstream from the fuel supplying device, wherein the guide body has a stepped portion extending in a direction intersecting with a direction of a flow of intake air and has a curved cross-section, and separated passages separated by the guide body are formed in the intake passage.

A fourth aspect of the present disclosure is the intake apparatus of an engine according to any one of first to third aspect, wherein a plurality of the stepped portions is arranged in parallel.

A fifth aspect of the present disclosure is the intake apparatus of an engine according to any one of first to fourth aspects, wherein the holes are formed at parts displaced from the stepped portion.

A sixth aspect of the present disclosure is the intake apparatus of an engine according to any one of first to fifth aspects, wherein the multiple holes located upstream of the flow of the intake air are different from the multiple holes located downstream of the flow of the intake air in size.

A seventh aspect of the present disclosure is the intake apparatus of an engine according to any one of first to sixth aspects, wherein the holes located upstream of the flow of the intake air are larger and the holes located downstream of the flow of the intake air are smaller.

An eighth aspect of the intake apparatus of an engine according to any one of first to seventh aspects, wherein each of the holes is a choking hole whose passage cross-sectional area is narrowed on one side.

A ninth aspect of the present disclosure is the intake apparatus of an engine according to the eighth aspect, wherein the choking hole includes a large-diameter passage portion and a small-diameter passage portion.

A tenth aspect of the present disclosure is the intake apparatus of an engine according to the eighth aspect, wherein the choking hole is gradually narrowed from a large-diameter passage to a small-diameter passage.

An eleventh aspect of the present disclosure is the intake apparatus of an engine according to the ninth or tenth aspect, wherein the choking holes are arranged so that narrowed sides the respective choking holes are alternately located on opposite sides of the guide body.

A twelfth aspect of the present disclosure is the intake apparatus of an engine according to any one of the first to seventh aspects, wherein the holes are through holes where passage cross-sectional areas of the respective holes are equal to one another.

A thirteenth aspect of the present disclosure is the intake apparatus of an engine according to any one of the first to twelfth aspects, wherein the guide body having the multiple holes is disposed in the intake passage of a 2-stroke engine.

A fourteenth aspect of the present disclosure is the intake apparatus of an engine according to any one of fist to twelfth aspects, wherein the guide body having the multiple holes is disposed in the intake passage of a 4-stroke engine.

The present disclosure has the following effects by the above configurations.

According to the first aspect of the present disclosure, the guide body having the multiple holes is disposed in the intake passage located downstream from the fuel supplying device and has the stepped portion extending in the direction intersecting with the direction of the flow of the intake air. Consequently, fuel supplied from the fuel supplying device is mixed with air, and the intake air changes in flow rate and is atomized through further generation of turbulence due to the stepped portion of the guide body having the multiple holes. Since the air-fuel mixture atomized in the two stages is supplied, combustion efficiency and fuel consumption are improved. Also, since fuel components in the atomized air-fuel mixture remain in the plural holes as droplets, and the residual air-fuel mixture is supplied in the subsequent intake stroke, the combustion efficiency is further improved, and harmful components in exhaust gas can be reduced.

According to the second aspect of the present disclosure, the guide body having the multiple holes is disposed in the intake passage located downstream from the fuel supplying device and has the curved cross-section, and the separated passages separated by the guide body are formed in the intake passage. Consequently, fuel supplied from the fuel supplying device is mixed with air, and the intake air changes in flow rate in the separated passages separated by the curve of the guide body having the curved cross-section and is atomized through further generation of turbulence due to the guide body having the multiple holes. Since the air-fuel mixture atomized in the two stages is supplied, combustion efficiency and fuel consumption are improved. Also, since fuel components in the atomized air-fuel mixture remain in the plural holes as droplets, and the residual air-fuel mixture is supplied in the subsequent intake stroke, the combustion efficiency is further improved, and harmful components in exhaust gas can be reduced.

According to the third aspect of the present disclosure, the guide body having the multiple holes is disposed in the intake passage located downstream from the fuel supplying device, has the stepped portion extending in the direction intersecting with the direction of the flow of the intake air, and has the curved cross-section, and the separated passages separated by the guide body are formed in the intake passage. Consequently, fuel supplied from the fuel supplying device is mixed with air, the intake air changes in flow rate due to the stepped portion of the guide body having the multiple holes, and the intake air changes in flow rate in the separated passages separated by the curve of the guide body having the curved cross-section and is atomized through further generation of turbulence. Since the air-fuel mixture atomized in the two stages is supplied, combustion efficiency and fuel consumption are improved. Also, since fuel components in the atomized air-fuel mixture remain in the plural holes as droplets, and the residual air-fuel mixture is supplied in the subsequent intake stroke, the combustion efficiency is further improved, and harmful components in exhaust gas can be reduced.

According to the fourth aspect of the present disclosure, the intake air hits against the plural parallel stepped portions and is atomized through further generation of turbulence, and combustion efficiency and fuel consumption are improved.

According to the fifth aspect of the present disclosure, by forming the holes at the parts displaced from the stepped portion, the intake air hits against the stepped portion and is atomized through further generation of turbulence by the holes, and combustion efficiency and fuel consumption are improved.

According to the sixth aspect of the present disclosure, the multiple holes have different sizes on the upstream side and the downstream side in the direction of the flow of the intake air, and thus the intake air is atomized through further generation of turbulence.

According to the seventh aspect of the present disclosure, the holes are larger on the upstream side in the direction of the flow of the intake air and smaller on the downstream side, and thus the intake air is atomized through further generation of turbulence on the upstream side while the blown-back air-fuel mixture can be stopped on the downstream side.

According to the eighth aspect of the present disclosure, each of the holes is a choking hole whose passage cross-sectional area is narrowed on one side. Consequently, the intake air changes in flow rate and is atomized through further generation of turbulence.

According to the ninth aspect of the present disclosure, the choking hole includes the large-diameter passage portion and the small-diameter passage portion. Consequently, the intake air changes in flow rate due to a change in passage diameter and is atomized through further generation of turbulence.

According to the tenth aspect of the present disclosure, the choking hole is gradually narrowed from the large-diameter passage to the small-diameter passage. Consequently, the intake air changes in flow rate due to a change in passage diameter and is atomized through further generation of turbulence.

According to the eleventh aspect of the present disclosure, the choking holes are arranged to alternate the narrowed sides on both sides of the guide body, and thus the intake air is atomized through further generation of turbulence.

According to the twelfth aspect of the present disclosure, each of the holes is the through hole having the equal passage cross-sectional area, and thus the intake air is higher in flow rate and is atomized through further generation of turbulence.

According to the thirteenth aspect of the present disclosure, the guide body having the multiple holes is disposed in the intake passage of the 2-stroke engine. Consequently, combustion efficiency and fuel consumption are improved in the 2-stroke engine.

According to the fourteenth aspect of the present disclosure, the guide body having the multiple holes is disposed in the intake passage of the 4-stroke engine. Consequently, combustion efficiency and fuel consumption are improved in the 4-stroke engine.

DESCRIPTION OF THE EMBODIMENTS

Embodiments of an intake apparatus of an engine according to the present disclosure will be described below with reference to the accompanying drawings, but the present disclosure is not limited to these embodiments.

Configuration of Engine (2-Stroke Engine)

Figure 1:
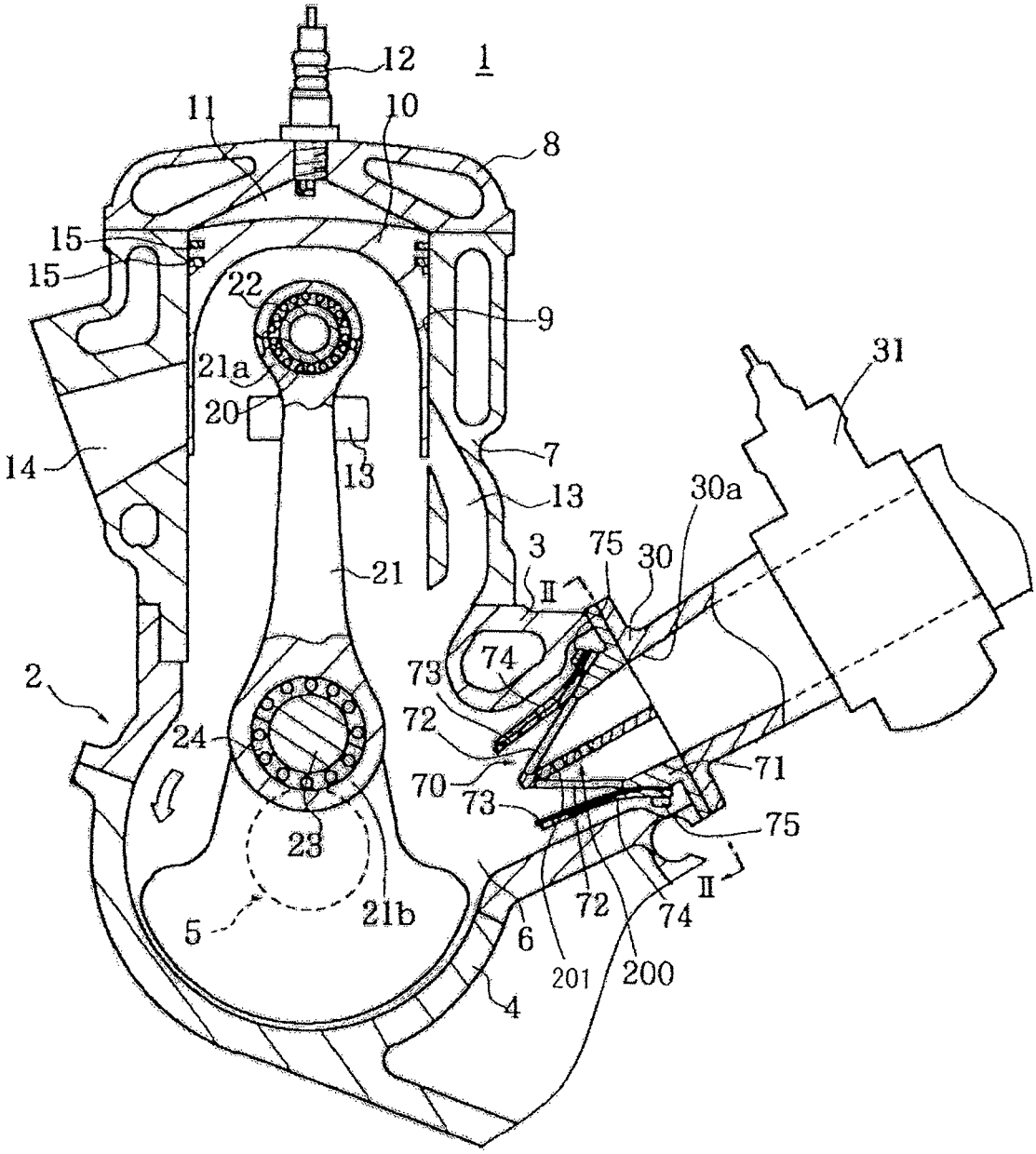
FIG. 1 is a vertical cross-sectional view depicting a 2-stroke engine provided with an intake apparatus.
Figure 2:
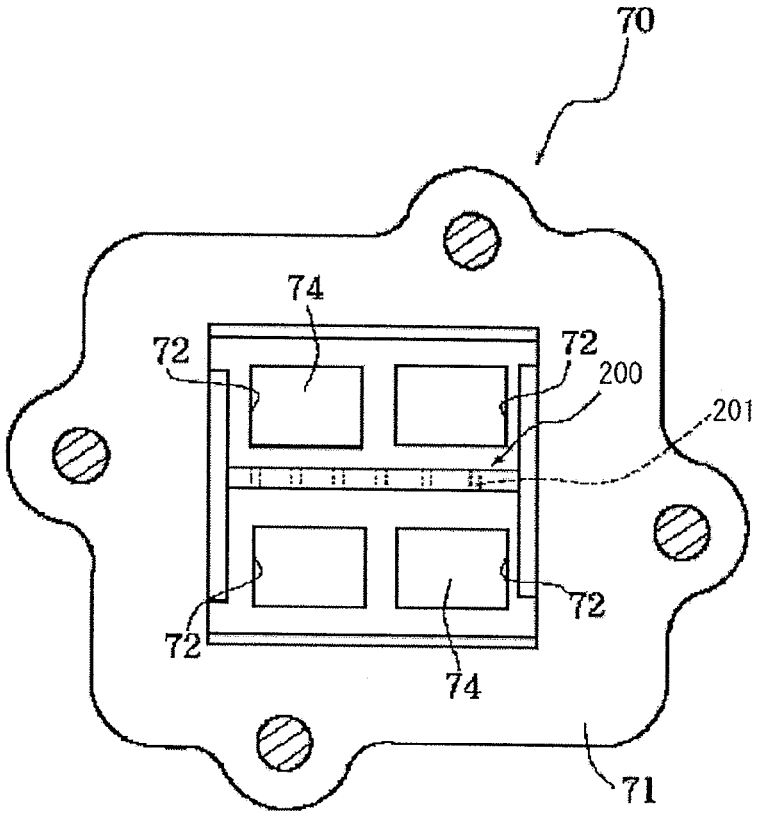
FIG. 2 is a cross-sectional view taken along the line II-II in FIG. 1.

FIGS. 1 and 2 illustrates an embodiment made by applying the present disclosure to a 2-stroke engine, where FIG. 1 is a vertical cross-sectional view of the 2-stroke engine provided with an intake apparatus and FIG. 2 is a cross-sectional view taken along the line II-II in FIG. 1.

According to the present disclosure, in the intake apparatus of the engine provided with a fuel supplying device for supplying fuel into an intake passage, a guide body 200 having multiple holes 201 is disposed in the intake passage located downstream from the fuel supplying device.

The engine of the present embodiment is a 2-stroke engine 1, and the 2-stroke engine 1 includes a crank case 2 having an upper case 3 and a lower case 4. A crank shaft 5 is pivotally supported between the upper case 3 and the lower case 4, and a crank chamber 6 is constructed of the upper case 3 and the lower case 4.

A cylinder block 7 is attached to the upper case 3, and a cylinder head 8 is attached to the cylinder block 7. A piston 10 is reciprocally disposed in a cylinder 9 formed in the cylinder block 7. A combustion chamber 11 is a space defined by the cylinder 9, the head of the piston 10, and the cylinder head 8. A spark plug 12 is attached to the cylinder head 8, while facing the combustion chamber 11. In the cylinder block 7, there are three scavenging passages 13 and an exhaust passage 14. The scavenging passages 13 make the crank chamber 6 communicate with the combustion chamber 11 in the scavenging stroke, and the exhaust passage 14 discharges exhaust gas in the combustion chamber 11 in the exhaust stroke. Two of the three scavenging passages 13 are oppositely arranged to each other in a radial direction of the cylinder 9 while the other scavenging passage 13 is oppositely arranged opposite to the exhaust passage 14 between the two opposed scavenging passages 13.

Two piston rings 15 are disposed on the upper portion of the piston 10. A small end 21*a* of a connecting rod 21 is rotatably supported by a piston pin 20 through a bearing 22, where the piston pin 20 is provided at the piston 10. In addition, a large end 21*b* of the connecting rod 21 is supported by a crank pin 23 of the crank shaft 5 through a bearing 24. By the connecting rod 21, the reciprocating motion of the piston 10 is converted into a rotating motion and is transmitted to the crank shaft 5.

An intake pipe 30 is connected to the upper case 3 of the crank case 2 through a reed valve 70. Furthermore, a carburetor 31 is connected to the intake pipe 30 and serves as a fuel supplying device. In the reed valve 70, an intake port 72 is formed in a body 71, and a valve 73 and a valve stopper 74 that open and close the intake port 72 are fastened together with a screw 75. The valve 73 of the reed valve 70 opens during the intake stroke, in which the crank chamber 6 is under negative pressure, to intake an air-fuel mixture from an intake passage 30*a* of the intake pipe 30. In this manner, the reed valve 70 allows only a flow of intake air from the intake pipe 30 to the crank chamber 6. The crank chamber 6 serves as a primary compression chamber for the intake air.

In the reed valve 70 arranged at the intake passage 30*a* located downstream from the carburetor 31 as a fuel supplying device, the guide body 200 having the multiple holes 201 is disposed. The guide body 200 is in a plate shape and made of a metal, such as aluminum, stainless steel, or copper; a carbon material; a wood; or a bamboo.

As a result of disposing the guide body 200 having the multiple holes 201 in the intake passage of the 2-stroke engine 1, fuel supplied from the fuel supplying device is mixed with air in the 2-stroke engine 1, and the intake air changes in flow rate and is atomized through further generation of turbulence due to the guide body 200 having the multiple holes 201. Since the air-fuel mixture atomized in the two stages is supplied, combustion efficiency and fuel consumption are improved. Also, since fuel components in the atomized air-fuel mixture remain in the plural holes as droplets, and the residual air-fuel mixture is supplied in the subsequent intake stroke, the combustion efficiency is further improved, and harmful components in exhaust gas can be reduced.

(4-Stroke Engine)

Figure 3:
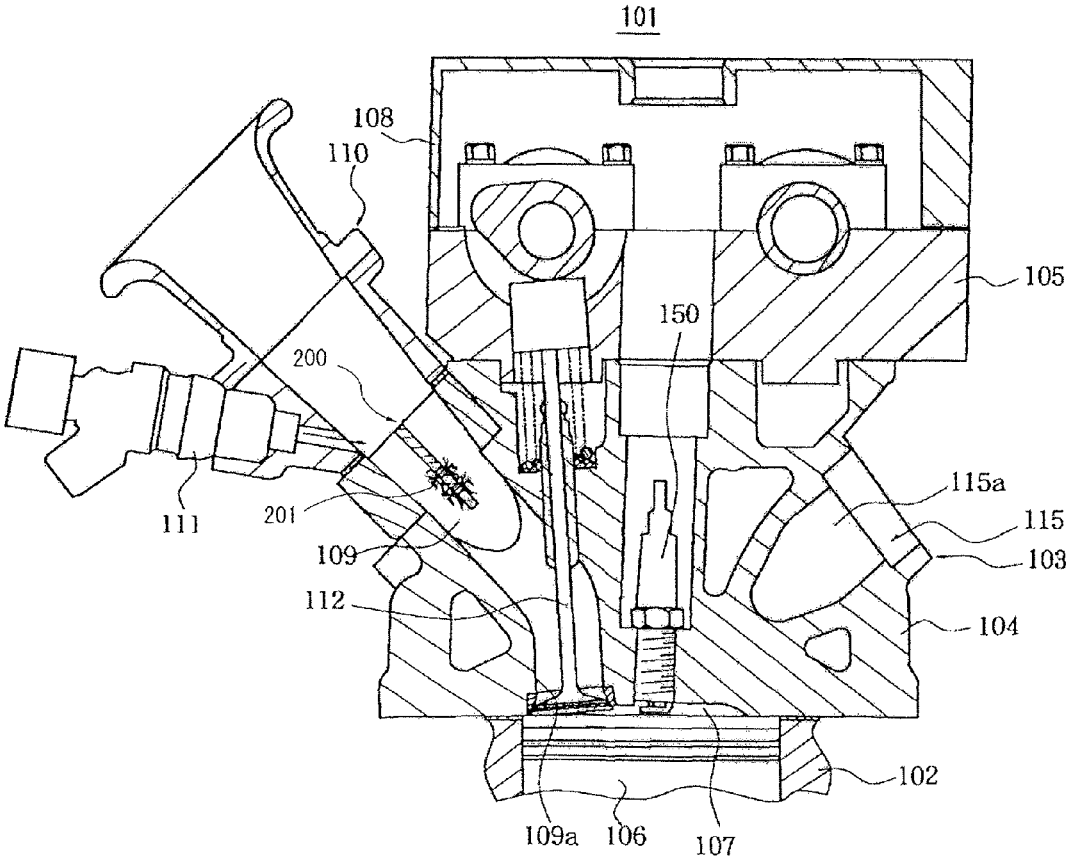
FIG. 3 is a vertical cross-sectional view depicting a 4-stroke engine provided with an intake apparatus.

Next, an embodiment made by applying the present disclosure to a 4-stroke engine will be described. FIG. 3 is a vertical cross-sectional view of the 4-stroke engine provided with an intake apparatus.

In the present embodiment, a cylinder head 103 is attached to a cylinder block 102 of a 4-stroke engine 101 having multiple cylinders and is constituted by a head lower portion 104 and a head upper portion 105. A combustion chamber 107 is a space defined by the head lower portion 104 and a piston 106 fitted in the cylinder block 102, and a head cover 108 is attached to the head upper portion 105. An intake passage 109 is formed in the head lower portion 104 and is opened to the combustion chamber 107 by three branching passages 109*a*.

The branching passages 109*a* of the intake passage 109 are provided with an intake valve 112, respectively. Thus, the intake valve 112 is opened and closed to supply an air-fuel mixture to the combustion chamber 107. Also, an exhaust passage 115 is formed in the head lower portion 104, in which a pair of branching passages 115*a* is opened to the combustion chamber 107. The branching passages 115*a* are provided with exhaust valves (not shown), respectively. Thus, the exhaust value is opened and closed to discharge exhaust gas from an exhaust pipe (not shown) connected to the exhaust passage 115.

An intake pipe 110 is connected to the intake passage 109 and is provided with an injector 111 as a fuel supplying device. The injector 11 injects fuel at a predetermined timing. Also, a spark plug 150 is attached to the head lower portion 104 while facing the combustion chamber 107.

In the intake passage 109 located downstream from the injector 111 provided as a fuel supplying device, the guide body 200 having the multiple holes 201 is disposed along a direction of a flow of intake air.

Fuel supplied from the injector 111 is mixed with air, and the intake air is atomized through further generation of turbulence due to the guide body 200 having the multiple holes 201. Since the air-fuel mixture atomized in the two stages is supplied, combustion efficiency is improved. As a result, a further improvement in fuel consumption is attained. Also, the combustion efficiency is further improved because fuel components in the atomized air-fuel mixture remain in the plural holes 201 of the guide body 200 as droplets and the residual air-fuel mixture is supplied in the subsequent intake stroke.

Also, regardless of an attaching direction of the intake passage 109, an atomizing rate of the air-fuel mixture can be further improved without decreasing the flow rate of the flow of the intake air, the combustion efficiency and the fuel consumption can be improved, and harmful components in exhaust gas, such as carbon monoxide (CO), hydrocarbon (HC), and nitrogen oxide (NOx), can be reduced.

Configuration of Guide Body

First Embodiment

Figure 4:
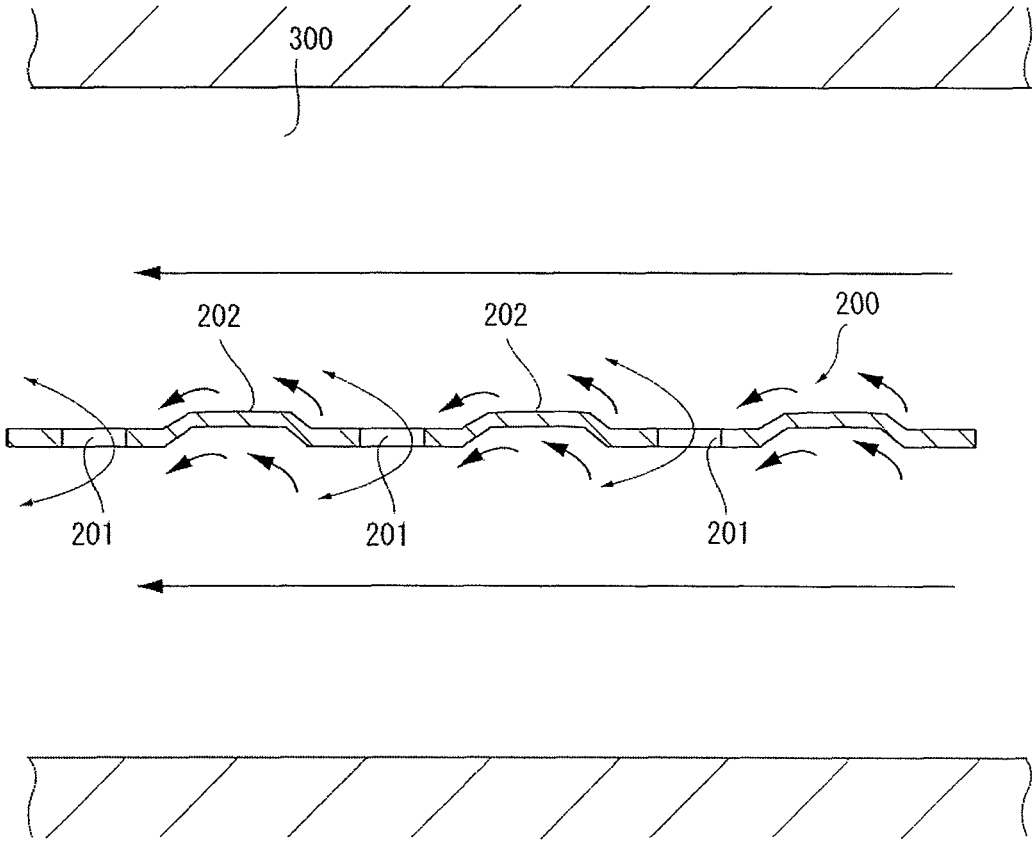
FIG. 4 is a cross-sectional view depicting an intake passage in a state of having a guide body of a first embodiment arranged therein.
Figure 5:
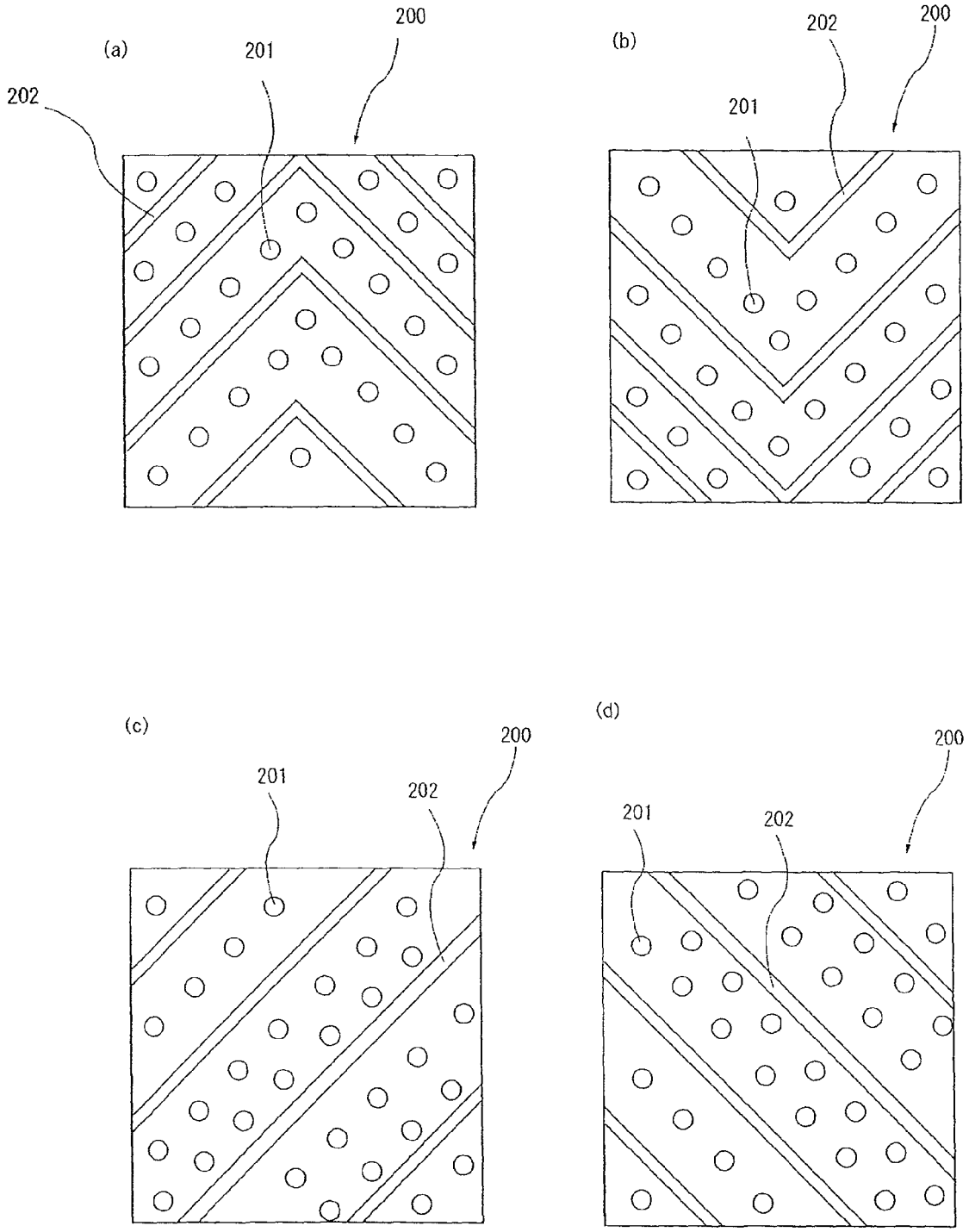
FIGS. 5A to 5D are plan views each depicting the guide body.
Figure 6:
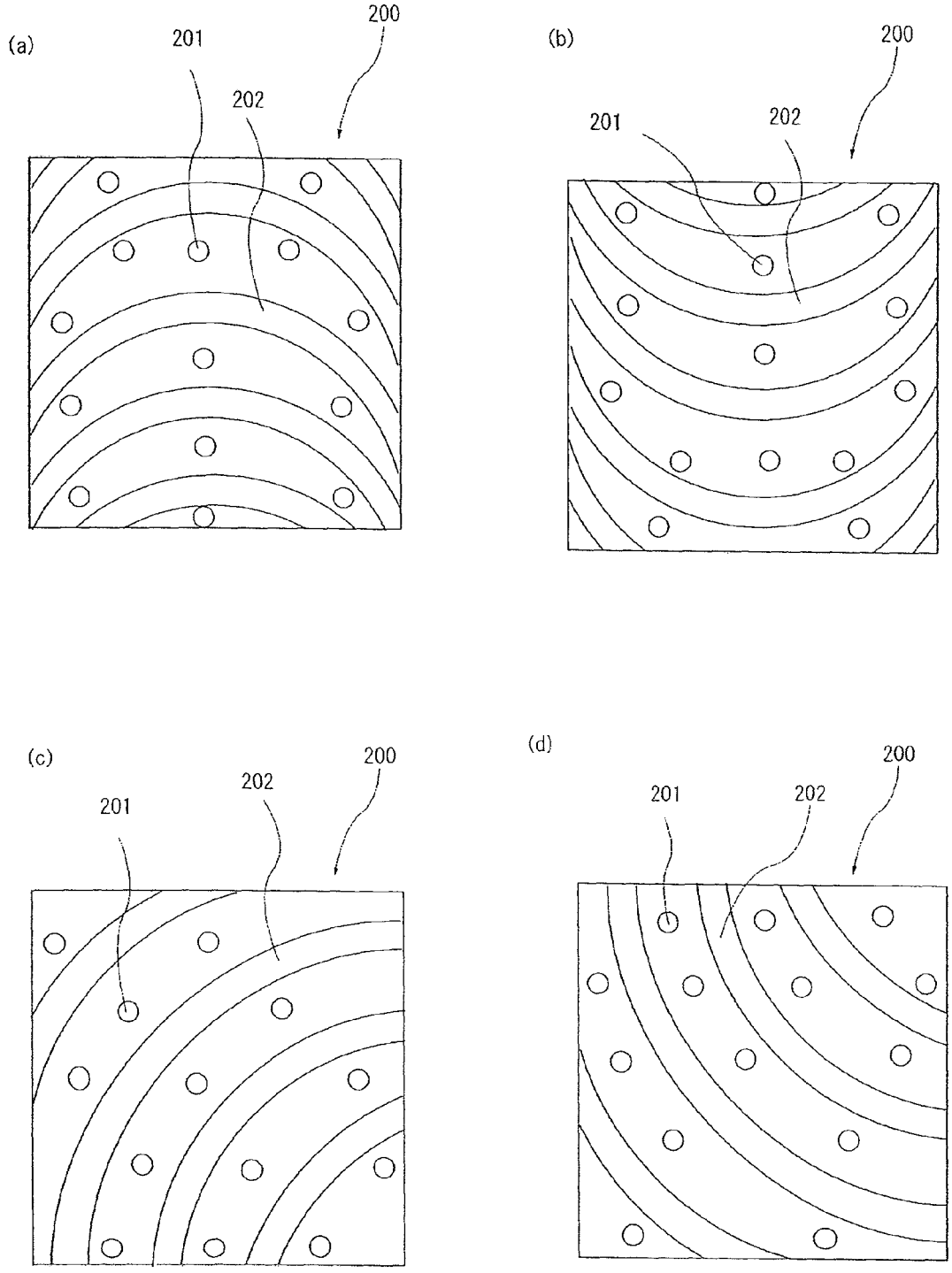
FIGS. 6A to 6D are plan views each depicting the guide body.
Figure 7:
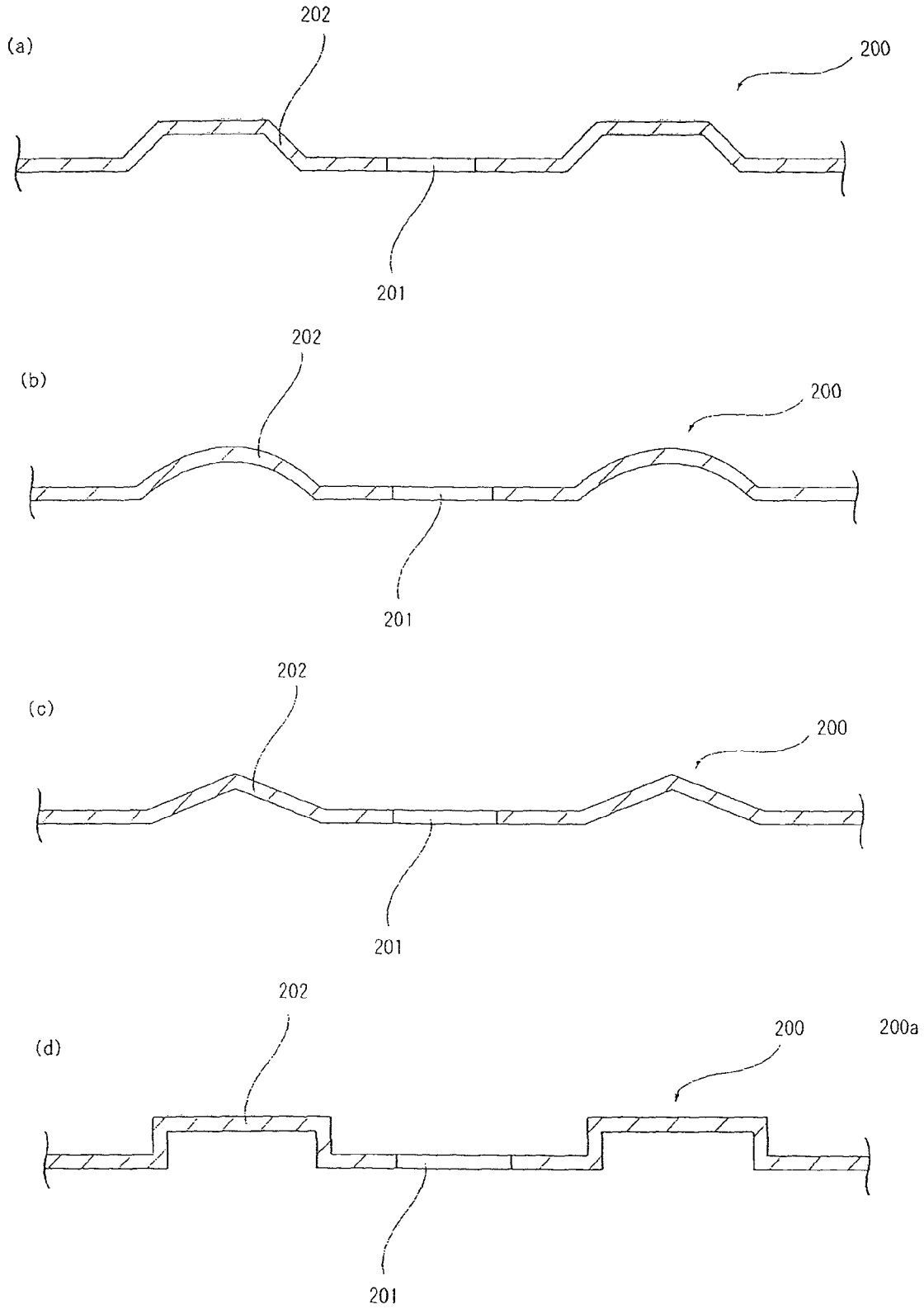
FIGS. 7A to 7D are cross-sectional views each depicting the guide body.
Figure 8:
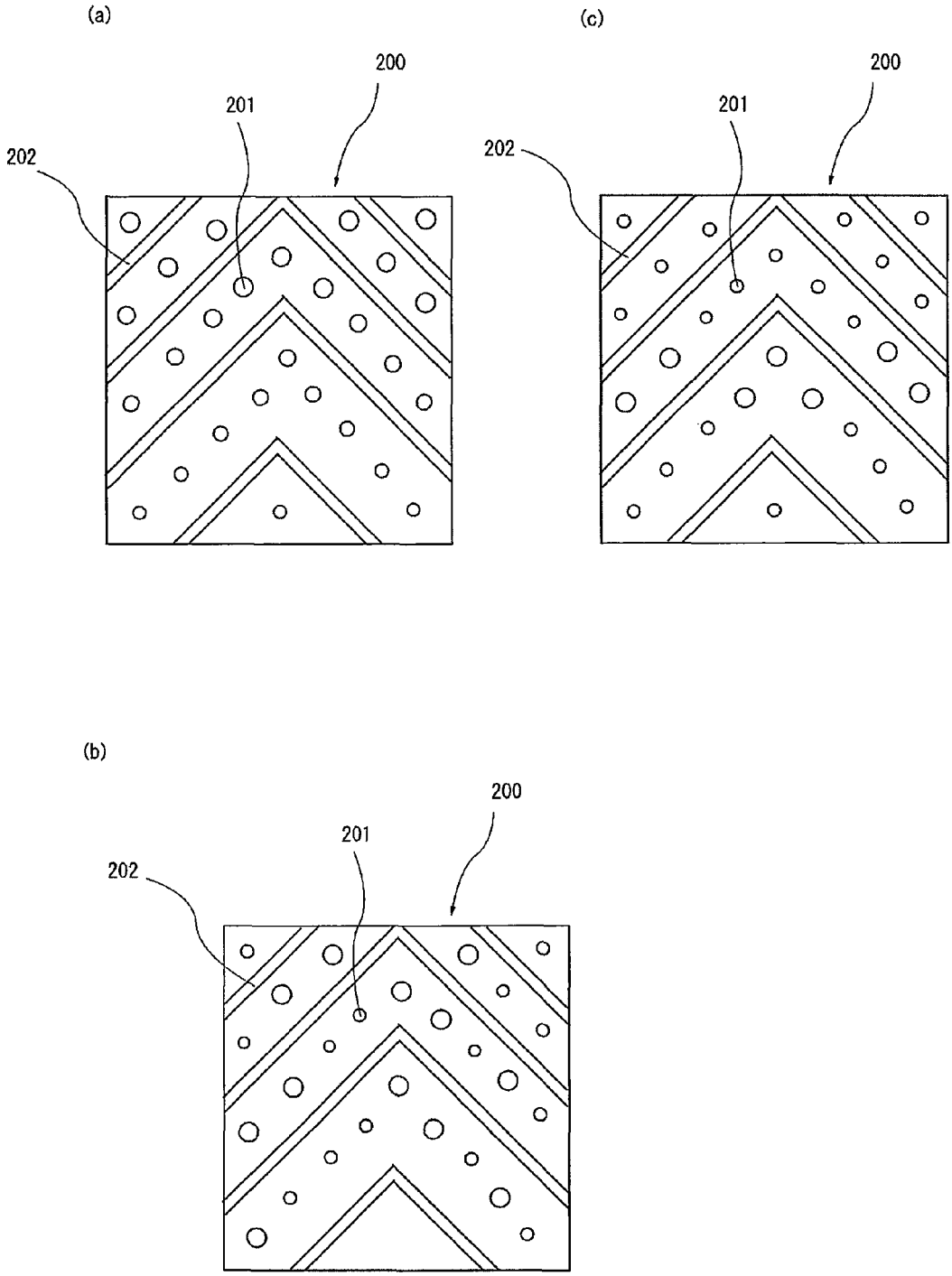
FIGS. 8A to 8C are plan views each depicting the guide body.
Figure 9:
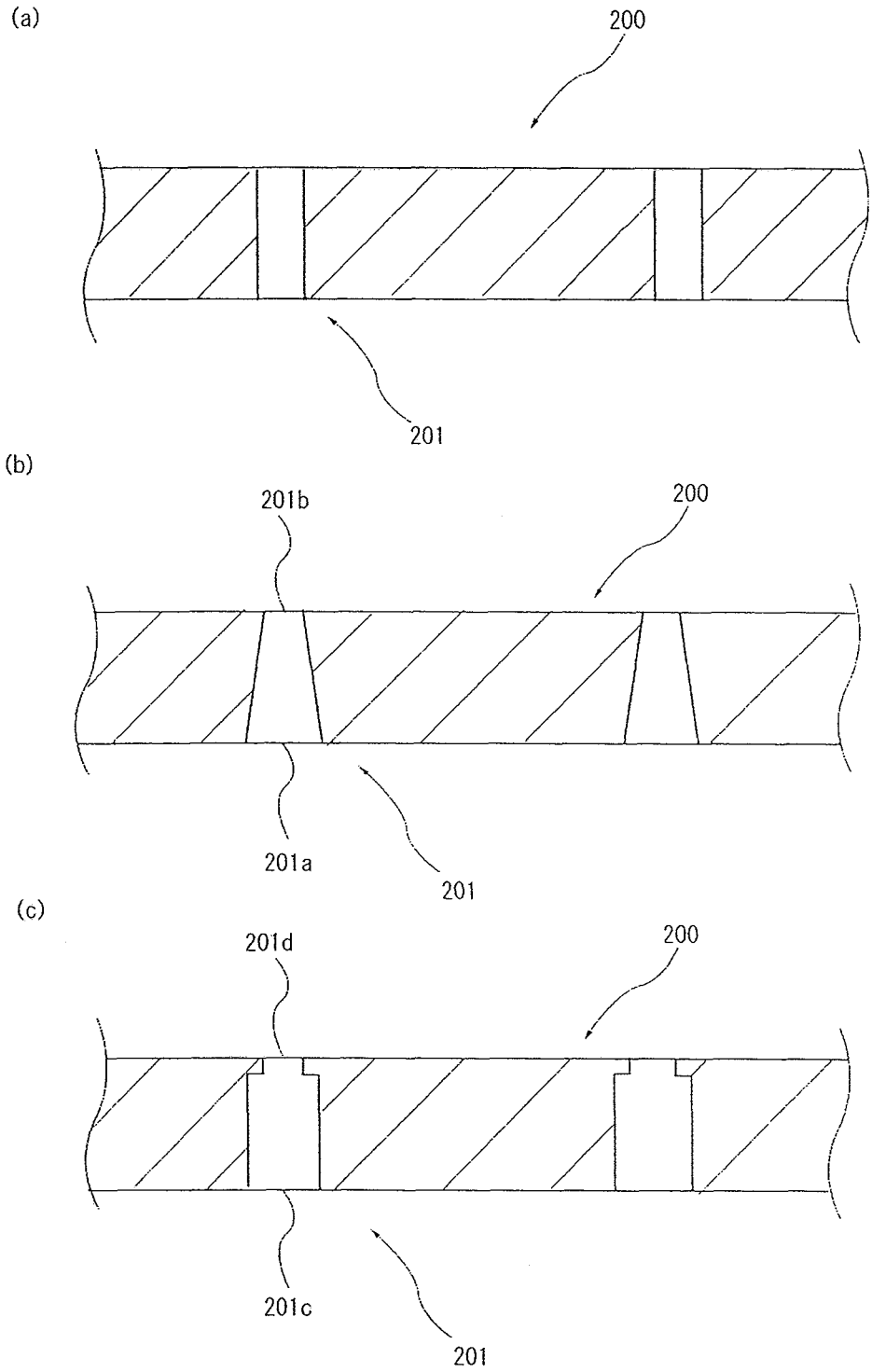
FIGS. 9A to 9C are cross-sectional views each depicting the hole part of the guide body.

Configurations of the guide body in a first embodiment are illustrated in FIGS. 4 to 9. FIG. 4 is a cross-sectional view depicting an intake passage in a state of having the guide body arranged therein, FIGS. 5A to 5D and 6A to 6D are plan views each depicting the guide body, FIGS. 7A to 7D are cross-sectional views depicting the guide body, FIGS. 8A to 8C are plan views each depicting the guide body, and FIGS. 9A to 9C are cross-sectional views each depicting the hole part of the guide body. In the first embodiment, the guide body 200 having the multiple holes 201 is disposed in an intake passage 300 located downstream from a fuel supplying device and has stepped portions 202 each extending in a direction intersecting with a direction of a flow of intake air, and a plurality of stepped portions 202 are arranged in parallel. The multiple holes 201 are formed by a punching process, a cutting process, or the like, and the stepped portions 202 are formed by a bending process, a cutting process, or the like. Also, the holes 201 are formed at parts displaced from the stepped portions 202.

In the first embodiment, the guide body 200 having the multiple holes 201 is disposed in the intake passage 300 located downstream from the fuel supplying device, is in a plate shape, and has the stepped portions 202 extending in the direction intersecting with the direction of the flow of the intake air. Consequently, fuel supplied from the fuel supplying device is mixed with air due to the multiple holes 201, and the intake air changes in flow rate as the intake air hits against the stepped portions 202 and is atomized through further generation of turbulence. Since an air-fuel mixture atomized in the two stages is supplied, the combustion efficiency and fuel consumption are improved.

In the embodiments in FIGS. 5A to 5D, although the stepped portions 202 extend approximately at an angle of 45 degrees with respect to the direction intersecting with the direction of the flow of the intake air, the angle is not limited to this but may be any angle as long as it is an angle not perpendicular to the direction, and the intake air can change in flow rate as the intake air hits the stepped portions 202. In FIG. 5A, two stepped portions 202 intersect with each other at an angle of approximately 45 degrees and are configured so that the intersection may be located upstream of the flow of the intake air, in FIG. 5B, two stepped portions 202 are configured so that the intersection may be located downstream of the flow of the intake air, and in FIGS. 5C and 5D, one stepped portion 202 is configured to extend at an angle of approximately 45 degrees. Also, by arranging plural stepped portions 202 in parallel, the intake air hits against the plural parallel stepped portions 202 and is atomized through further generation of turbulence, and the combustion efficiency and the fuel consumption are improved.

In the embodiments in FIGS. 6A to 6D, the stepped portions 202 are in circular arcs and extend at a predetermined angle with respect to the direction intersecting with the direction of the flow of the intake air. In FIG. 6A, the stepped portion 202 is configured so that the projecting side of the circular arc-stepped portion 202 may be located at the center of the upstream side in the direction of the flow of the intake air, in FIG. 6B, the stepped portion 202 is configured so that the projecting side of the circular arc-stepped portion 202 may be located at the center of the downstream side in the direction of the flow of the intake air, in FIG. 6C, the stepped portion 202 is configured so that the projecting side of the circular arc-stepped portion 202 may be obliquely located upstream of the flow of the intake air, and in FIG. 6D, the stepped portion 202 is configured so that the projecting side of the circular arc-stepped portion 202 may be obliquely located downstream of the flow of the intake air.

In the first embodiment, the stepped portion 202 is formed by a bending process by pressure molding. In FIG. 7A, the stepped portion 202 has a cross-section of a trapezoidal shape. In FIG. 7B, the stepped portion 202 has a cross-section of a curved shape. In FIG. 7C, the stepped portion 202 has a cross-section of a triangular shape. In FIG. 7D, the stepped portion 202 has a cross-section of a U shape. The cross-sectional shape of the stepped portion 202 is not limited to any of those in the present embodiment.

Next, configurations of the hole of the guide body in the first embodiment are illustrated in FIGS. 8A to 8C and 9A to 9C. FIGS. 8A to 8C are plan views each depicting the guide body, and FIGS. 9A to 9C are cross-sectional views each depicting the guide body. The multiple holes 201 of the guide body 200 located upstream of the flow of the intake air are different from those located downstream thereof in size. Thus, the holes 201 with different sizes cause the intake air to be atomized through further generation of turbulence. Also, the multiple holes 201 are formed at parts displaced from the stepped portions 202. Consequently, the intake air hits against the stepped portions 202 and is atomized by the holes 201 through the further generation of turbulence, and the combustion efficiency and the fuel consumption are improved.

In FIG. 8A, the holes 201 located upstream of the flow of the intake air are configured to be larger and those located downstream thereof are configured to be smaller. In FIG. 8B, the holes 201 are configured to be gradually smaller from upstream to downstream of the flow of the intake air. In FIG. 8C, the holes 201 are configured to be smaller on the upstream side in the direction of the flow of the intake air, larger at the center, and smaller on the downstream side of the flow.

In FIG. 9A, each of the holes 201 is a through hole having an equal passage cross-sectional area. In FIG. 9B, each of the holes 201 is a choking hole whose passage cross-sectional area is narrowed on one side and is gradually narrowed from a large-diameter passage 201*a* to a small-diameter passage 201*b*. In FIG. 9C, each of the holes 201 is a choking hole and includes a large-diameter passage portion 201*c* and a small-diameter passage portion 201*d*. In a case where the holes 201 are choking holes, they can be arranged to alternate the narrowed sides on both sides of the guide body 200 as depicted in FIGS. 9B and 9C. When each of the holes 201 is a choking hole whose passage cross-sectional area is narrowed on one side in this manner, the intake air further changes in flow rate by the choking holes and is atomized through the further generation of turbulence.

Second Embodiment

Figure 10:
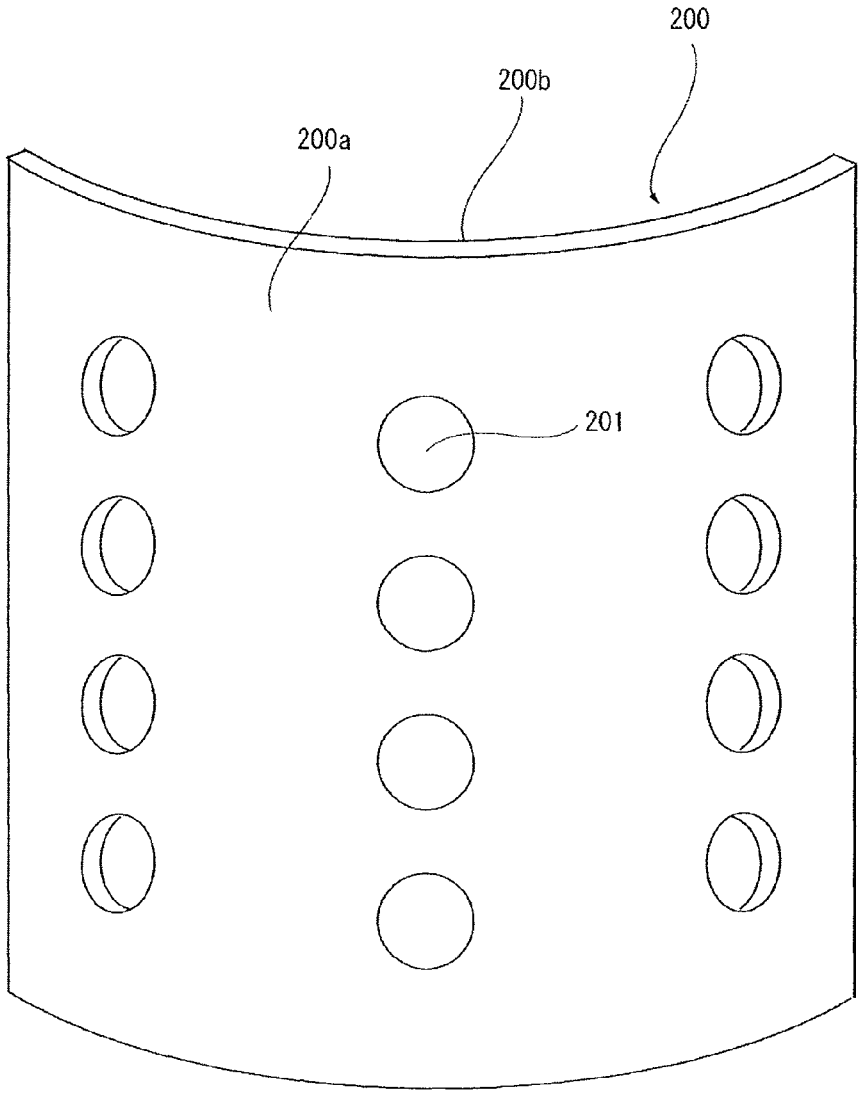
FIG. 10 is a perspective view depicting the guide body of a second embodiment.
Figure 11:
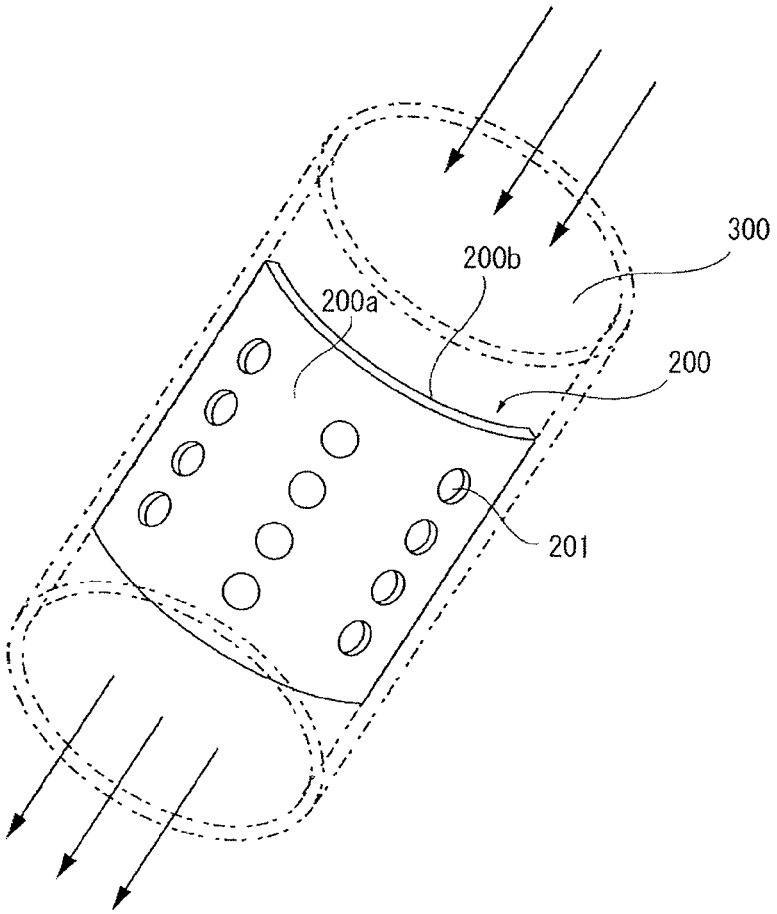
FIG. 11 is a schematic perspective view depicting a state of arranging the guide body in the intake passage.
Figure 12:
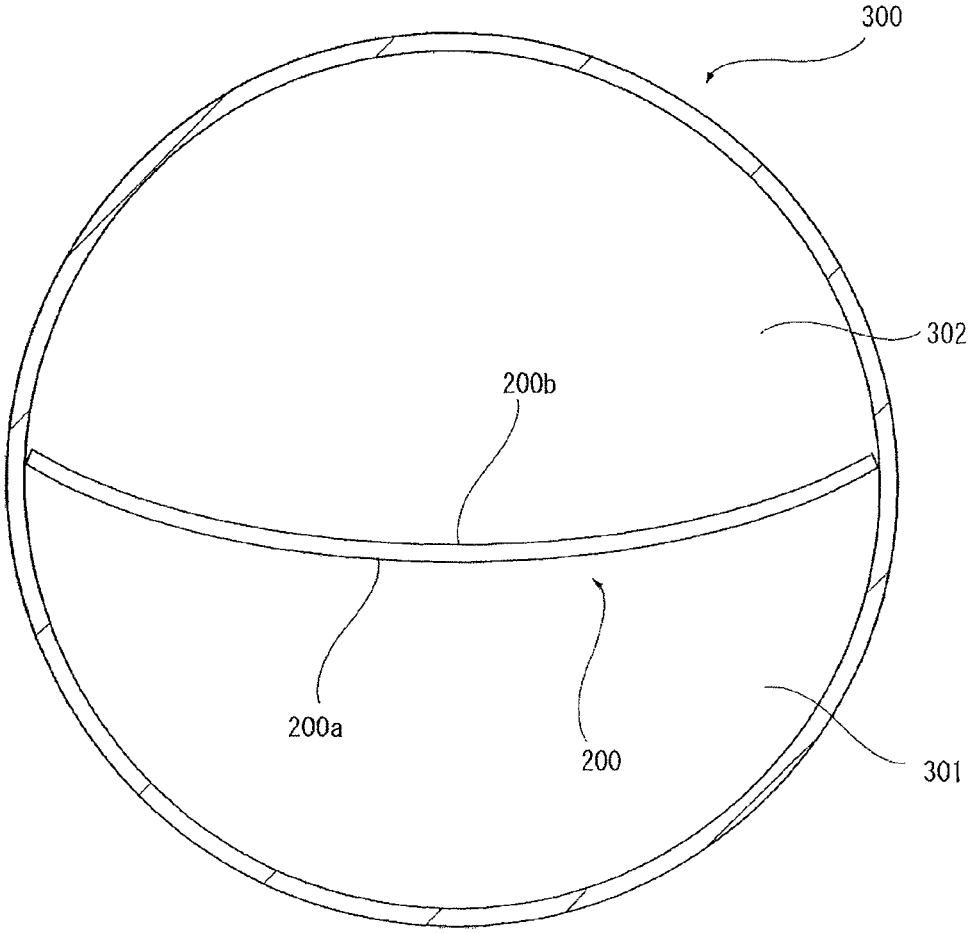
FIG. 12 is a cross-sectional view depicting the intake passage in which the guide body is arranged.

A configuration of the guide body in a second embodiment is shown in FIGS. 10 to 12. FIG. 10 is a perspective view of the guide body, FIG. 11 shows a state of arranging the guide body in the intake passage, and FIG. 12 is a cross-sectional view of the intake passage in which the guide body is arranged. In the second embodiment, the guide body 200 having the multiple holes 201 is disposed in the intake passage located downstream from a fuel supplying device.

The guide body 200 has a curved cross-section and forms separated passages 301 and 302 separated by the guide body 200 in the intake passage 300. The guide body 200 has the multiple holes 201, and the holes 201 are arranged to have equal sizes in a direction of a flow of intake air in FIG. 10 and are configured in a similar manner to that of the first embodiment.

In the second embodiment, the guide body 200 having the multiple holes 201 is disposed in the intake passage 300 located downstream from the fuel supplying device, has the curved cross-section, and forms the separated passages 301 and 302 separated by the guide body 200 in the intake passage 300. Consequently, fuel supplied from the fuel supplying device is mixed with air, and the intake air changes in flow rate in the separated passages 301 and 302 separated by the curve of the guide body 200 having the curved cross-section. That is, the flow rate in the separated passage 301 formed by the side of a projecting surface 200*a* of the curve of the guide body 200 is higher than the flow rate in the separated passage 302 formed by the side of a recessed surface 200*b* of the curve of the guide body 200. Also, the intake air is atomized through further generation of turbulence due to the multiple holes 201 of the guide body 200. Since an air-fuel mixture atomized in the two stages is supplied, combustion efficiency and fuel consumption are improved.

Third Embodiment

Figure 13:
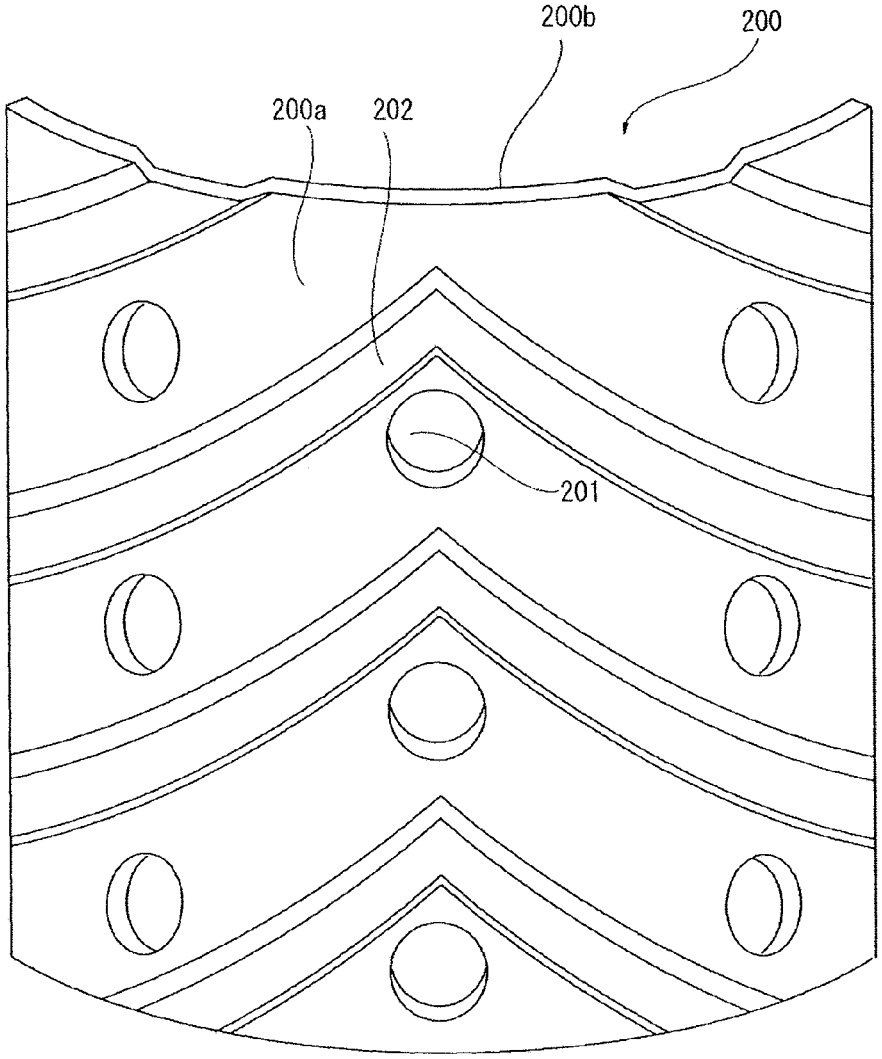
FIG. 13 is a perspective view depicting the guide body of a third embodiment.
Figure 14:
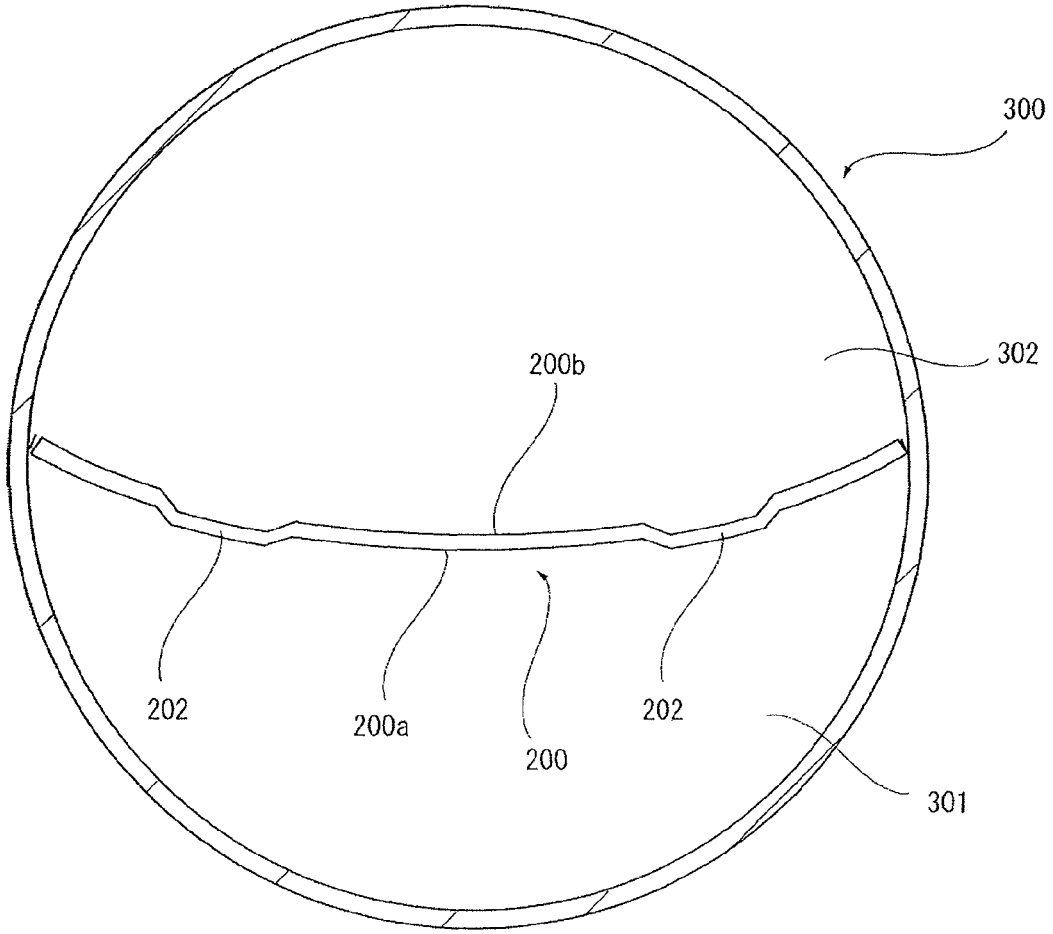
FIG. 14 is a cross-sectional view depicting the intake passage in which the guide body is arranged.

A configuration of the guide body in a third embodiment is illustrated in FIGS. 13 and 14. FIG. 13 is a perspective view of the guide body, and FIG. 14 is a cross-sectional view of the intake passage in which the guide body is arranged. In the third embodiment, the guide body 200 having the multiple holes 201 is disposed in the intake passage located downstream from a fuel supplying device.

The guide body 200 has a curved cross-section in a similar manner to that of the second embodiment and forms the separated passages 301 and 302 separated by the guide body 200 in the intake passage 300. The guide body 200 of the third embodiment has the stepped portions 202 each extending in a direction intersecting with a direction of a flow of intake air, and the stepped portions 202 are configured in a similar manner to that in the first embodiment.

In the third embodiment, the guide body 200 having the multiple holes 201 is disposed in the intake passage 300 located downstream from the fuel supplying device, has the stepped portions 202 each extending in the direction intersecting with the direction of the flow of the intake air, has the curved cross-section, and forms the separated passages 301 and 302 separated by the guide body 200 in the intake passage 300. Consequently, fuel supplied from the fuel supplying device is mixed with air, and the intake air changes in flow rate due to the stepped portions 202 of the guide body 200 having the multiple holes 201.

The intake air further changes in flow rate in the separated passages 301 and 302 separated by the curve of the guide body 200 having the curved cross-section. That is, the flow rate in the separated passage 301 formed by the side of the projecting surface 200*a* of the curve of the guide body 200 is higher than the flow rate in the separated passage 302 formed by the side of the recessed surface 200*b* of the curve. Also, the intake air is atomized through further generation of turbulence due to the multiple holes 201 of the guide body 200. Since an air-fuel mixture atomized in the two stages is supplied, combustion efficiency and fuel consumption are improved.

Fourth Embodiment

Configurations of the guide body in a fourth embodiment are illustrated in FIGS. 15A to 15D. FIGS. 15A to 15D are cross-sectional views of the intake passages in which the guide bodies are arranged. In the fourth embodiment, the guide body 200 having the multiple holes 201 is disposed in the intake passage located downstream from a fuel supplying device. Although the guide body 200 of the present embodiment differs from those of the first to third embodiments in terms of a tubular shape, it is configured in a similar manner in other respects. Thus, the description is omitted.

Figure 15:
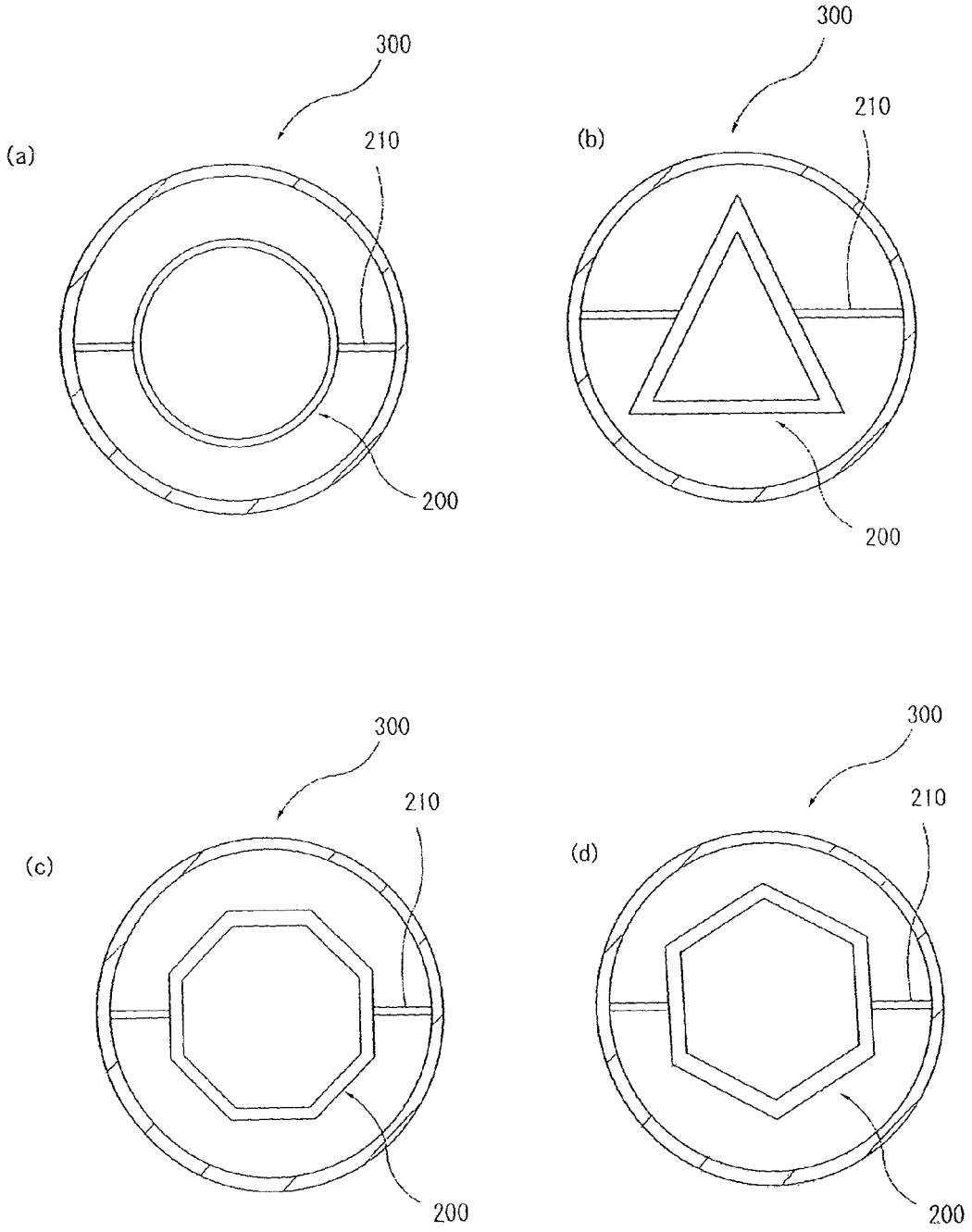
FIGS. 15A to 15D are cross-sectional views each depicting the intake passages in which the guide bodies of a fourth embodiment are arranged.

FIG. 15A illustrates an example of the embodiment in which the guide body 200 has a circular cross-section. FIG. 15B illustrates another example of the embodiment in which the guide body 200 has a triangular cross-section in an embodiment. FIG. 15C illustrates another example of the embodiment in which the guide body 200 has an octagonal cross-section in an embodiment. FIG. 15D illustrates another example of the embodiment in which the guide body 200 has a hexagonal cross-section in an embodiment. Each of them is arranged in the intake passage 300 by a pair of ribs 210. The pair of ribs 210 may be fixed in the intake passage 300 by press fitting or by engagement with recesses. Also, the pair of ribs 210 may be provided with holes. In the present embodiment, the surface area of the guide body 200 is secured to enable further generation of turbulence.

The present disclosure is an engine mounted in a vehicle such as a two-wheeled motor vehicle, is applied to an intake apparatus of a 2-stroke engine or a 4-stroke engine, improves an atomizing rate of an air-fuel mixture, improves combustion efficiency and fuel consumption, and reduces harmful components in exhaust gas.

What is claimed is:

1. An intake apparatus of an engine provided with a fuel supplying device for supplying fuel into an intake passage, comprising:

a guide body having multiple holes disposed in the intake passage located downstream from the fuel supplying device, wherein the guide body has a stepped portion extending in a direction intersecting with a direction of a flow of intake air and has a curved cross-section, and separated passages separated by the guide body are formed in the intake passage.

2. The intake apparatus of an engine according to claim 1, wherein a plurality of the stepped portions are arranged in parallel.

3. The intake apparatus of an engine according to claim 1, wherein the holes are formed at parts displaced from the stepped portion.

4. The intake apparatus of an engine according to claim 1, wherein multiple holes are located upstream of the flow of the intake air and are different in size from multiple holes located downstream of the flow of the intake air.

5. The intake apparatus of an engine according to claim 1, wherein holes located upstream of the flow of the intake air are larger than holes located downstream of the flow of the intake air.

6. The intake apparatus of an engine according to claim 1, wherein each of the holes is a choking hole whose passage cross-sectional area is narrowed on one side.

7. The intake apparatus of an engine according to claim 6, wherein the choking hole includes a large-diameter passage portion and a small-diameter passage portion.

8. The intake apparatus of an engine according to claim 6, wherein the choking hole is gradually narrowed from a large-diameter passage to a small-diameter passage.

9. The intake apparatus of an engine according to claim 7, wherein the choking holes are arranged so that narrowed sides of the respective choking holes are alternately located on opposite sides of the guide body.

10. The intake apparatus of an engine according to claim 1, wherein the holes are through holes where passage cross-sectional areas of the respective holes are equal to one another.

11. The intake apparatus of an engine according to claim 1, wherein the guide body is disposed in the intake passage of a 2-stroke engine.

12. The intake apparatus of an engine according to claim 1, wherein the guide body is disposed in the intake passage of a 4-stroke engine.

* * * * *